US005349931A

United States Patent [19]

Gottlieb et al.

[11] Patent Number: 5,349,931

[45] Date of Patent: Sep. 27, 1994

[54] AUTOMATIC VEHICLE STARTER

[75] Inventors: Mark Gottlieb, Annandale; Harry Powell, Shipman, both of Va.

[73] Assignee: Design Tech International, Inc., Springfield, Va.

[21] Appl. No.: 82,545

[22] Filed: Jun. 28, 1993

[51] Int. Cl.[5] ..... F02N 11/08

[52] U.S. Cl. ..... 123/179.2; 123/179.3; 290/38 C; 307/10.6

[58] Field of Search ..... 123/179.2, 179.3, 179.4; 307/10.6; 290/38 C, 38 R; 180/167

[56] References Cited

U.S. PATENT DOCUMENTS

| | | | |
|---|---|---|---|
| Re. 30,686 | 7/1981 | Bucher | 123/179.2 |
| 2,338,460 | 1/1944 | Schmitt | 290/36 R |
| 3,163,769 | 12/1964 | Keuchen et al. | 290/38 A |
| 3,681,658 | 8/1972 | Naoi et al. | 361/33 |
| 3,862,429 | 1/1975 | Bucher | 123/179.2 |
| 4,198,945 | 4/1980 | Eyermann et al. | 123/179.3 |
| 4,362,133 | 12/1982 | Malik | 123/179.4 |
| 4,732,120 | 3/1988 | Naito et al. | 123/179.3 |
| 4,947,051 | 8/1990 | Yamamoto et al. | 290/38 R |
| 5,072,703 | 12/1991 | Sutton | 123/179.4 |

*Primary Examiner*—Andrew M. Dolinar

*Attorney, Agent, or Firm*—Oblon, Spivak, McClelland, Maier & Neustadt

[57] ABSTRACT

An automatic vehicle starter in which a temperature sensor may sense a temperature of the engine. The vehicle starter may then remotely crank a starter motor of the vehicle. The duration of time that the starter motor is cranked will be based on the sensed temperature. In this way, a vehicle can be cranked for an appropriate amount of time without requiring any tachometer sensing operation. Also, to insure that the vehicle has been properly started, after a signal to remotely start the vehicle is transmitted, a first battery voltage is measured. Then, the ignition to the vehicle is turned on so that all turned on accessories will have power supplied thereto. A battery voltage is then again measured, this battery voltage representing the battery voltage with a load applied thereto from the turned on accessories having power supplied thereto. The vehicle is then automatically started. The battery voltage is then continuously measured and, if it determined that the battery voltage falls below a predetermined value, it will indicate that the vehicle has stalled. The vehicle can then automatically be restarted to insure proper starting or can be turned off.

19 Claims, 4 Drawing Sheets

AUTOMATIC VEHICLE STARTER

BACKGROUND OF THE INVENTION

1. Field of the Invention

An automatic vehicle starter is typically used so that an operator can start a vehicle by a transmitter and without actually being inside the vehicle. In a typical automatic vehicle starter, an operator can simply push a button on a miniature transmitter to start up a vehicle. This is most often done in cold climates so that one can remotely start an automobile from inside one's home, so that the automobile is pre-heated and ready to drive away 5 or 10 minutes after it is remotely started.

2. Discussion of the Background

Conventional remote vehicle starters typically use some kind of tachometer sensing system to detect the rpms at which the engine is running, to determine how long to crank a starter motor during starting so as to crank the starter motor for a long enough period of time to start the engine. However, such systems must also try to avoid overcranking the starter motor. Typically, a remote starter should crank a starter motor until the rpms get above 400–600, at which time power to the starter motor is released but power to the ignition circuit is still applied. There are a variety of known ways to determine this tachometer input. One typical way is to place a tachometer sensor wire at the negative "–" side of the ignition coil or to place an inductive pickup sensor around one of the spark-plug wires. This will typically provide the tachometer information. This same tachometer information is also used to determine whether the car is still running. It is important to determine whether a car is still running so that everything can be turned off if the engine stalls while being remotely started.

However, such conventional remote vehicle starters suffer from significant drawbacks. First, there is a difficulty in that in some vehicles the tachometer pickup points and even spark plug wires altogether are not readily accessible or may not be accessible at all. In such systems it may not be possible to use a remote vehicle starter, or it may be very difficult to accurately get a tachometer determination. Furthermore, in diesel vehicles there are no tachometer pickup points, so that conventional remote vehicle starters cannot be used at all in diesel vehicles.

SUMMARY OF THE INVENTION

Accordingly, one object of the present invention is to provide a novel automatic vehicle starter in which it is not necessary to get a tachometer sensing to remotely start a vehicle.

One further object of the present invention is to provide a novel automatic vehicle starter which can be used in diesel vehicles which do not have any points where a tachometer sensing operation can be performed.

One method in which the system of the present invention can achieve these objectives is by first transmitting a signal to a remote vehicle starter to remotely start the vehicle. Then, the initial voltage on the vehicle battery is measured. Power to the ignition and accessories in the vehicle is then turned on so that all turned on accessories have power supplied thereto. A voltage at the battery is then measured again, this voltage representing the battery voltage with a load applied thereto from the turned on accessories which have power supplied thereto. The vehicle is then remotely started, i.e. the starter motor is cranked. Then, the battery voltage is measured continuously. At this time, it is then determined whether the battery voltage falls below a predetermined level, which will indicate that the vehicle has stalled. In this situation where a stall is determined, everything is turned off and the starting cycle is started again. In this way, it can be guaranteed that the vehicle has started.

As a further feature of the present invention, it can be accurately determined for what duration of time the starting motor should be cranked, without requiring any tachometer sensing operation. The present invention achieves this objective by determining a temperature at the engine, and then cranking the starter motor for a predetermined time based on the measured temperature.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
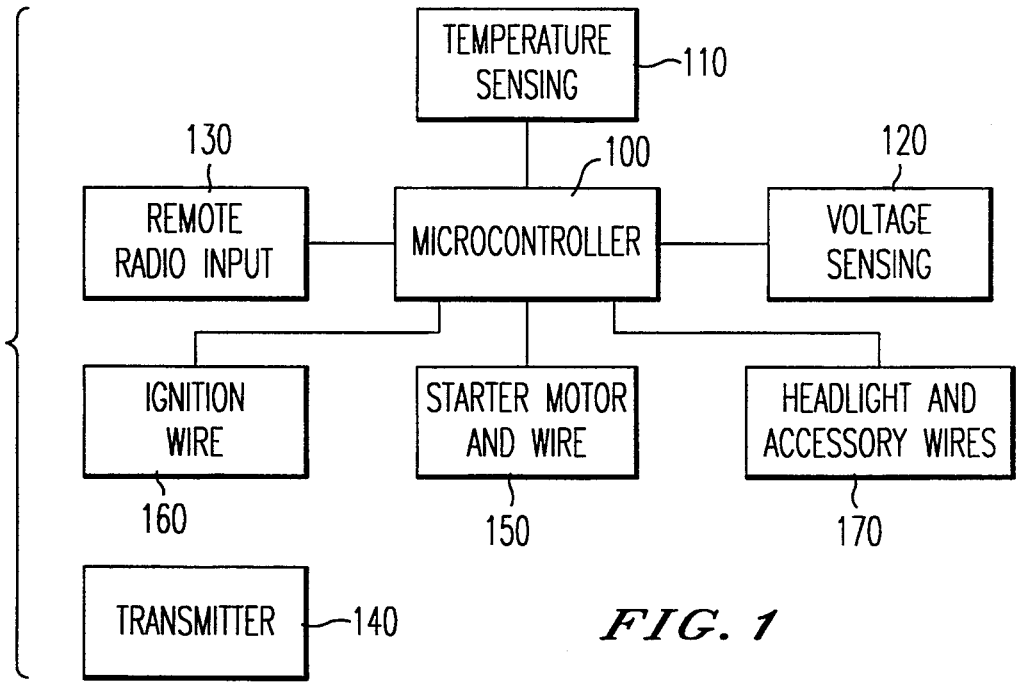
FIG. 1 shows an overall system design of the remote vehicle starter according to the present invention.

Referring now to the drawings, wherein like reference numerals designate identical or corresponding parts throughout the several views, and more particularly to FIG. 1 thereof, there is shown an overall design of the automatic vehicle starter system of the present invention. As shown in FIG. 1, the vehicle starter of the present invention features a microcontroller 100 to which is connected a remote radio input 130 for receiving a remote signal from a transmitter 140 indicating that the vehicle should be started, a temperature sensing circuit 110 and a voltage sensing circuit 120. The microcontroller 100 is also connected to the starter motor and wire 150 of the vehicle, to control cranking of the starter motor 150, and to sense how long the starter motor is being cranked. The microcontroller 100 is also connected to the ignition wire 160 to supply power thereto, and is also connected to the headlight and accessory wires 170 to supply power thereto.

According to one feature of the present invention, it can be accurately determined how long a starter motor in a vehicle should be cranked when the vehicle is remotely started. The present invention achieves this objective by taking into account the temperature of the engine. This obviates the need for any sort of tachometer sensing input.

This feature of the present invention is based on the fact that a vehicle takes shorter or longer to be started based on one main variable, the engine temperature. If the engine temperature is very cold, it may take 5 seconds of cranking the starter motor to start the vehicle. On the other hand, if the engine temperature is very warm, it may only take 0.8 seconds or so of cranking the starter motor to start the vehicle.

According to the present invention, an on-board temperature sensor can determine the engine temperature. Since the engine temperature cannot be easily measured directly, a temperature on-board which gives a good approximation of the engine temperature, particularly if the vehicle sits idle for a while, can be measured. A simplified method for sensing temperature can be achieved by placing an on-board temperature sensor on the starter module (under the dash). That is, the Applicants of the present invention have determined that one can approximate to a very close degree the engine temperature by sensing a temperature of a starter module. This is particularly true the longer the vehicle sits idle. However, other known temperature sensing methods can obviously also be employed. In the present invention, if it is very cold, it will take a few seconds of cranking a starter motor to start a vehicle. On the other hand, if it is warm, it will take just a fraction of a second to start the vehicle. Furthermore, there will be a gradient of cranking times between these two extremes for various temperatures.

The following TABLE 1 shows a typical look-up table of cranking times for different temperatures.

TABLE 1

| TEMP | CRANKING TIME FOR AUTOMOBILE | IGNITION TIME FOR DIESEL CARS |
|---|---|---|
| Less than 0° F. | 4 seconds | 30 seconds |
| 0° F. to 30° F. | 2.5 seconds | 20 seconds |
| 30° F. to 50° F. | 1.5 seconds | 15 seconds |
| 50° F. onward | 0.9 seconds | 10 seconds |

As is shown in the above-noted table, for different temperature ranges, different cranking times can be determined. TABLE 1 shows such cranking times for a conventional vehicle such as an automobile and also shows ignition time for a diesel powered vehicle. In the diesel powered vehicle, after the appropriate ignition time, then the starter motor is cranked for the corresponding cranking time.

That is, such a system of the present invention is particularly useful in diesel cars which do not have spark plug wires at all. Such diesel vehicles up until now have not been able to accept any conventional remote vehicle starter. In the case of diesel cars, power to the ignition wire would come on for a certain period of time prior to the actual cranking of the starter motor, as noted in TABLE 1 above. This would allow the glow plugs to reach their proper temperature before cranking, for easy starting. The cranking time would then be determined using TABLE 1 above, but the time before starting to crank the starter motor after the ignition wire has come on would also be variable as to temperature, as shown in TABLE 1 above.

Figure 2:
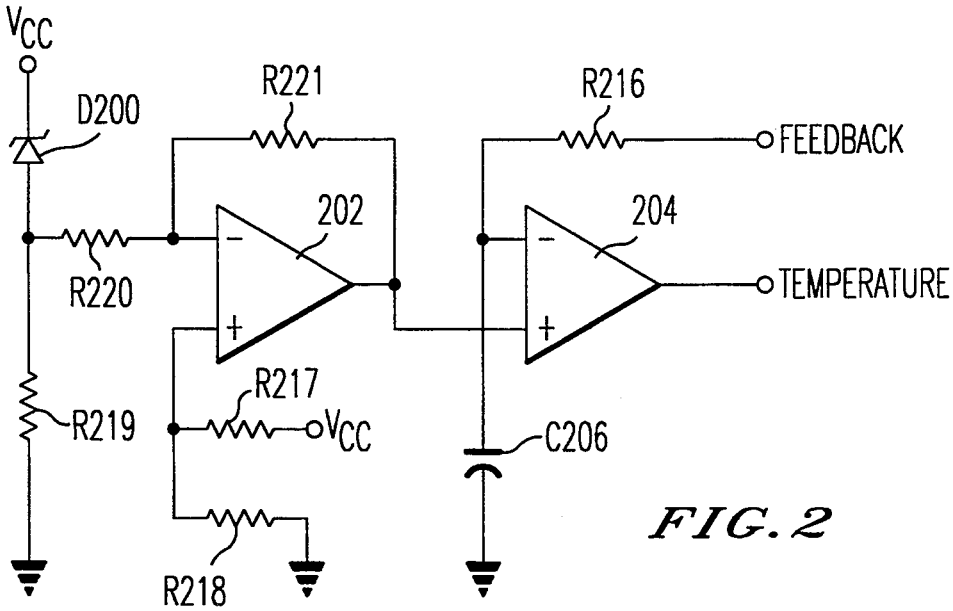
FIG. 2 shows the temperature sensing circuit of FIG. 1 in detail.

FIG. 2 details the temperature sensing circuit of the present invention. As shown in FIG. 2, the temperature sensing circuit of the present invention features a temperature sensitive diode D200, connected to power source vcc, which will sense the temperature, and which may be, as noted above, placed on the starter module. The output from this temperature sensing diode D200 is then fed into a negative input (−) of first operational amplifier 202 through resistor R220. Also, resistor R219 is connected to diode D200, and acts as a load resistor for the temperature sensing diode D200. Two resistors R217 and R218 are connected in parallel to the positive input (+) of amplifier 202. These two resistors R217 and R218 act as a bias point for amplifier 202. Further, resistor R221 is established between the negative input (−) into amplifier 202 and the output of amplifier 202. Resistors R220 and R221 establish a feedback network.

The output of first amplifier 202 is then fed into a second operational amplifier 204 at its positive input (+). A capacitor C206 and a resistor R216 are also connected to the negative input of the amplifier 204. In this way, the output of temperature sensing diode D200 is converted by the second amplifier 204, resistor R216 and capacitor C206. Resistor R216 and capacitor C206 act as a feedback integrator from the microcontroller 100 to the inverting input (−) of second amplifier 204. In this way, the outputs of amplifier 204 are sampled by the microcontroller 100 which then attempts to drive the feedback line in a direction which will force the voltage on capacitor C206 to equal the voltage on the non-inverting input (+).

When the power source vcc is 5 volts, typical values for the elements in FIG. 2 are as follows: R219=4.7K, R220=30K, R221=100K, R217=150K, R218=100K, R216=100K, C206=1 mF.

For example at 25° C. the voltage at the output of amplifier 202 would be about 1.8 V. This voltage is fed to the (+) positive input of amplifier 204. The microcontroller 100 charges capacitor C206 through resistor R216 and at the same time monitors the output of amplifier 204. When the voltage on capacitor C206 slightly exceeds that at the (+) positive input of amplifier 204, the output of amplifier 204 changes to a logical "low". At this point, the microcontroller 100 discharges capacitor C206 through resistor R216. From the charging and discharging rate, the microcontroller 100 can determine the voltage at the (+) positive input of amplifier 204, which will be proportional to the temperature of the temperature sensor. The voltage at the (+) positive input of amplifier 204 can be determined by other means such as using an A to D converter. Obviously, other temperature sensing devices can also be utilized.

One improvement in the system of the present invention is to allow an operator to "teach" a microprocessor the appropriate cranking time (at any given temperature) for the particular vehicle. Then, the microprocessor can use this "taught" value as a reference for the look-up table described above.

For example, a smaller car may take only 0.6 seconds of cranking at 70° F. to start up, while a bigger car may take 0.9 seconds at the same temperature of 70° F.

As one further feature of the present invention, the remote starter unit of the present invention may feature a "learn" switch, which may be depressed during installation. When this "learn" switch is depressed, the microcontroller 100 will sense the voltage applied to the starter wire to sense the length of time that the operator then cranks the vehicle. That is, the system of the present invention will operate so microcontroller 100 senses how long the operator is actually cranking the starter motor 150 to start the vehicle. This value can then become a base time from which the rest of the look-up table can be adjusted according to the different temperatures. Furthermore, it is also possible to use an average of several detected times to determine the appropriate crank time for the particular vehicle.

Figure 4:
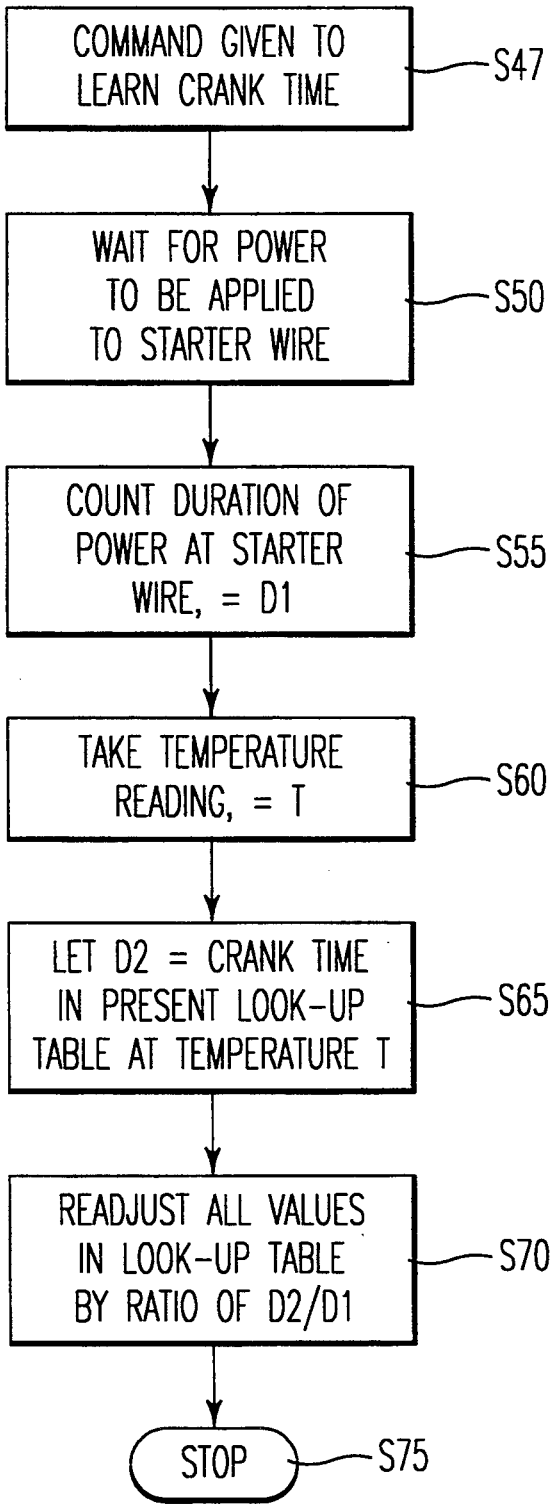
FIG. 4 is a flow chart detailing operation of a crank time learn operation.

The operation for varying the look-up table based on an actually detected starting operation is shown, for example, in FIG. 4. As shown in FIG. 4, after a command is given to learn a crank time at step S47, in step S50 the system waits until power is applied to the starter wire. After power is applied to the starter wire, the system proceeds to step S55 where the duration of time that power is applied is detected, and this value is stored as a value D1. At this time, the system then proceeds to step S60 in which a temperature reading T is taken by temperature sensing circuit 110. At this point, the present look-up table being utilized is then searched to find out which crank time corresponds to the detected temperature T. This current corresponding crank time is indicated as value D2. Then, the system proceeds to step S70 where all the values in the look-up table are adjusted by a ratio of D2/D1. In this way, each of the values in the look-up table can be adjusted based on the actual time that a starter motor is cranked. Obviously, the look-up table can be varied differently as noted above in FIG. 4.

As a further improvement in this system of the present invention, a further variable can be added to determine the amount of time that the car should be cranked. This further variable may be the amount of time since the vehicle was last run. That is, if a vehicle was run very recently, the time required for cranking the starter motor to start the vehicle will be reduced. On the contrary, when a vehicle has not been run for a long period of time, the time required to crank the starter motor to start the vehicle will be greater. The present invention can further determine the time that the starter motor should be cranked by factoring in this further variable.

For example, as is shown in TABLE 2 below, both of the variables of temperature and the amount of time since the vehicle was last run are used to determine cranking time. As shown in TABLE 2 below, the length in the time since the vehicle has last been run can be broken up into two units, which may be whether the vehicle has been run within 2 hours or whether it has been longer than 2 hours.

TABLE 2

| | FOR AUTOMOBILE | |
|---|---|---|
| TEMP | MORE THAN 2 HOURS CRANKING TIME | LESS THAN 2 HOURS CRANKING TIME |
| Less than 0° F. | 4 seconds | 2.0 seconds |
| 0° F. to 30° F. | 2.5 seconds | 1.6 seconds |
| 30° F. to 50° F. | 1.5 seconds | 1.1 seconds |
| 50° F. onward | 0.9 seconds | 0.7 seconds |

Furthermore, this can also be applied to a diesel vehicle as shown below in TABLE 3.

TABLE 3

| | FOR DIESEL VEHICLE | |
|---|---|---|
| TEMP | MORE THAN 2 HOURS DIESEL IGNITION TIME | LESS THAN 2 HOURS DIESEL IGNITION TIME |
| Less than 0° F. | 30 seconds | 20 seconds |
| 0° F. to 30° F. | 20 seconds | 12 seconds |
| 30° F. to 50° F. | 15 seconds | 10 seconds |
| 50° F. onward | 10 seconds | 6 seconds |

Obviously, greater time divisions can be added for more accurate cranking times and greater time divisions as to the length of time since the vehicle was last run can also be added.

As detailed above, according to the present invention, by factoring in the temperature, the amount of time that a starter motor should be cranked to start a vehicle can be determined. However, after a starter motor is cranked for a predetermined period of time, it must then be determined whether the vehicle has actually started to run, or whether it has stalled out for some reason.

According to the present invention, this can also be done without a conventional system which utilizes a tachometer type input.

This further feature of the present invention operates by sensing the battery voltage. The general concept is that when a vehicle is off, the battery voltage at rest is typically between 12 and 13 volts. When the vehicle is running, the alternator is in the charging process and keeps the battery at a higher level than if it were not charging. Typically, after the vehicle has started, the battery voltage is at a higher level than when the vehicle is at rest, because of the alternator charging the battery. However, this is not always the case. Very commonly, the battery voltage when the vehicle has started running will actually be lower than the battery voltage when the vehicle is at rest because all the accessories of the vehicle may be turned on after it starts. For example, the accessories such as the headlights, the heater, the air-conditioner as well as the ignition will be draining the battery after the vehicle has started. Thus, it is often the case that the battery voltage is actually less after the vehicle is running than when the vehicle is at rest. Typical values for these situations are shown below in TABLE 4. In TABLE 4, the low current draw situation is that in which very few accessories are on and the high current draw situation is that in which several of the accessories, such as the headlights, heater, air-conditioner, etc. are on.

TABLE 4

Typical Car Data Showing Voltage Variatons under Different Scenarios

| | | Battery Voltage |
|---|---|---|
| Car at Rest Not Running | $V_i$ | 12.6 |
| | LOW current draw $V_d$ | 11.9 |
| | HIGH current draw $V_d$ (measured after 1.5 seconds) | 11.6 |

| | Voltage after running for | | |
|---|---|---|---|
| | 2 sec | 10 sec | 1 min |
| LOW current draw after starting | 13.2 | 14.4 | 14.5 |
| Car Stalls - Read 3 secs after stall | 12.1 | 12.4 | 12.5 |
| Car Stalls - Read 10 secs after stall | 12.0 | 12.1 | 12.2 |
| HIGH current draw after starting | 12.3 | 12.5 | 13.0 |
| Car Stalls - Read 3 secs after stall | 11.5 | 11.7 | 12.0 |
| Car Stalls - Read 10 secs after stall | 11.5 | 11.5 | 11.6 |

Figure 3:
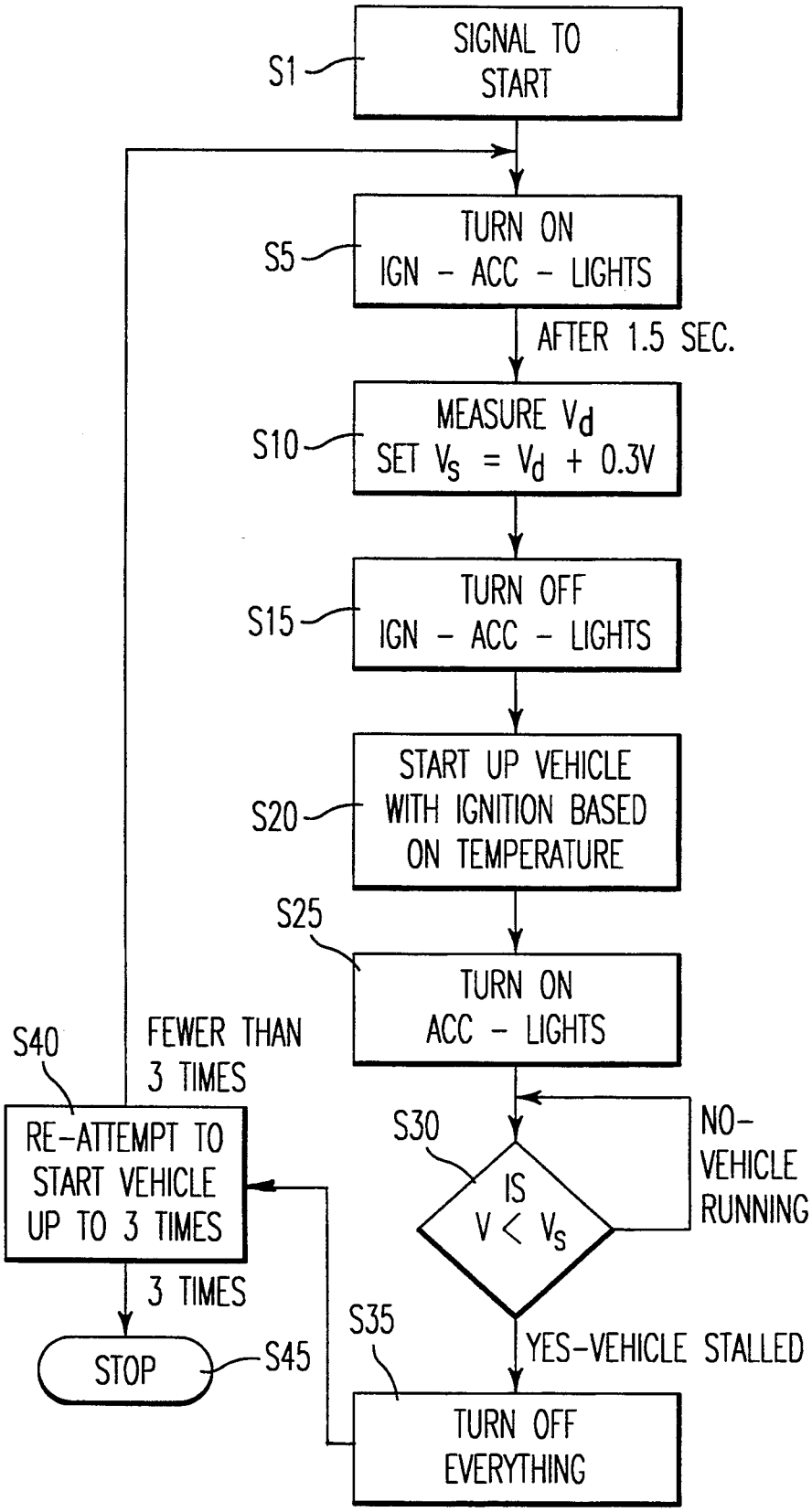
FIG. 3 is a flow chart detailing operation of the voltage sensing operation.

The vehicle starter of the present invention can compensate for this drawback by performing the following operation, which is shown in FIG. 3.

As shown in step S1, first a signal to start the vehicle will be provided by an operator from a handheld transmitter. At this point, the initial battery voltage $V_i$, which will represent the battery voltage at rest, is measured. As shown in Table 4, this battery voltage may typically be about 12.6 volts.

Then, according to the present invention, the ignition, air conditioning/heater, accessories and headlight wires will have power supplied thereto, as shown is step S5. In this situation, if any of these elements were turned on, they will have power supplied thereto, which will thereby drain the voltage on the battery. That is, at this point, anything that the operator of the vehicle has left on, such as the heater, will come on. This will put a load on the battery voltage causing it to "dip" to a low battery voltage value $V_d$. According to the present invention, this low battery voltage value $V_d$ is measured after 1.5 seconds, as shown in step S10.

After this voltage value $V_d$ is measured, the ignition, heater/air conditioner, accessories and headlight will be turned off, as shown in step S15, and the vehicle will be started as normal, i.e., power will be supplied to the ignition and the starter motor will be cranked for the appropriate amount of time, by factoring in the temperature and/or time since the vehicle was last run as detected by the look-up tables shown in TABLES 1–3 above, as is shown in step S20. The accessories and lights are then turned on, as shown in step S25.

After the vehicle is started, the battery voltage will be continually measured on an ongoing basis, as shown in step S30. Then, if it is determined that the battery voltage at any time drops below a "stall voltage" $V_s$, it can be determined that the vehicle has stalled. At this point, everything in the vehicle will be turned off, as shown in step S35, and then the vehicle will be again automatically started up to three times, as shown in step S40. This "stall voltage" may typically be the low battery voltage $V_d$, plus an appropriate increment, which typically may be 0.3 volts. If the vehicle stalls more than three times, operation of the vehicle starter may be ended, as shown in step S45.

This operation described above thereby allows the vehicle starter of the present invention to quickly and easily determine whether the vehicle is stalled. Further, this operation provides a significant advantage in that its operation is not affected by whether the operator has left any of the accessories, such as the headlights or the heater, turned on. By measuring the actual load across the battery just before starting and then after starting, the actual characteristics that the battery will show if the vehicle is running and if the vehicle stalls can be quickly and easily determined.

As a specific example, by utilizing the data shown in Table 4, in a case where a few accessories are turned on, the "low current" situation, the stall voltage $V_s$ will typically equal 12.2 volts (11.9+0.3 volts). In this situation, if after the vehicle is started the measured voltage across the battery is above 12.2 volts, this indicates that the vehicle is running. If the vehicle has stalled, the voltage will quickly drop below 12.2 volts, to indicate a stall.

In a second example in which several of the accessories are turned on, the "high current" situation, the stall voltage $V_s$ will typically equal 11.9 volts (11.6+0.3 volts). In this situation, if after the vehicle is started the measured voltage across the battery is above 11.9 volts, this indicates that the vehicle is running. If the vehicle has stalled, the voltage will quickly drop below the 11.9 volts of stall voltage $V_s$, thereby indicating a stalled vehicle.

Figure 5:
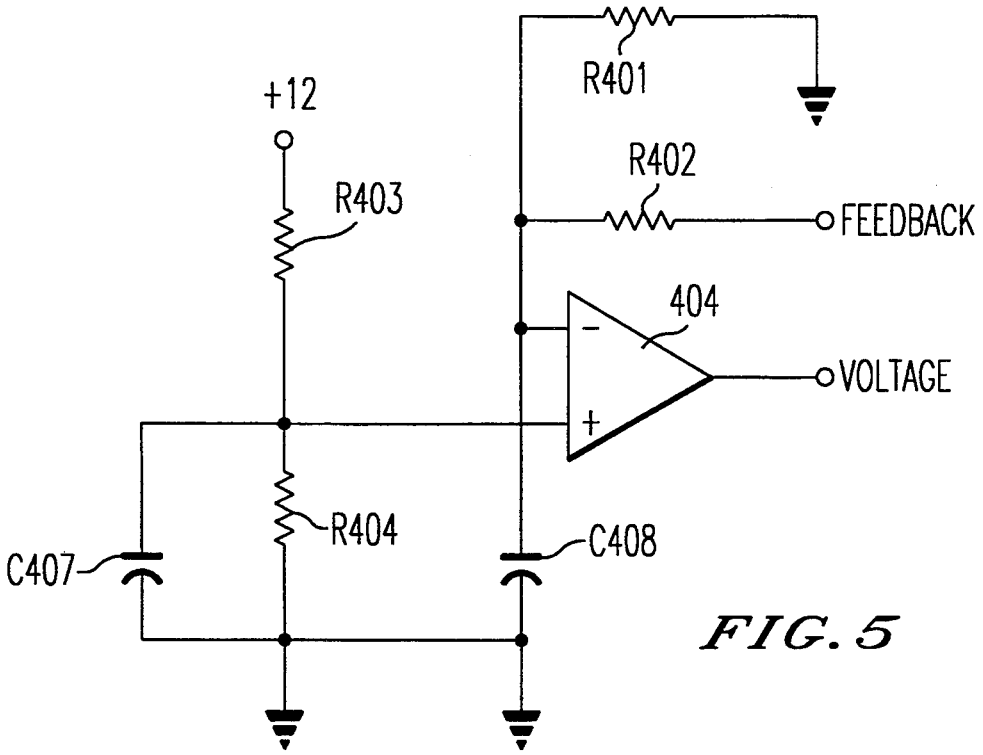
FIG. 5 shows the voltage sensing circuit of FIG. 1 in detail.

The circuit for providing this voltage sensing is shown in FIG. 5. As shown in FIG. 5, an input from the battery, shown as +12 volts, passes through a resistor R403 into the positive input (+) of an amplifier 404. Also connected to the positive input (+) of amplifier 404 are a parallel combination of a capacitor C407 and a resistor R404. Capacitor C408 is also connected to the negative input (−) of amplifier 404. Also connected to the negative input (−) of amplifier 404 is a parallel combination of a resistor R401 and a resistor R402. A feedback voltage from the microcontroller 100 is also fed through this resistor R402 into the negative input (−) of amplifier 404. The output of amplifier 404 will be fed to the microcontroller 100.

Typical values for the elements in FIG. 5 are as follows: R403=38K, R404=10K, R401=330K, R402=220K, C407=33 mF, C408=1 mF.

In this circuit of the present invention, resistors R403 and R404 form a voltage divider which reduces the voltage input from the battery by a factor of 5. Thus, the non-inverting input (+) to amplifier 404 will range up to approximately 3 volts at a high battery condition of 15 volts. Capacitor C407 operates with resistors R403 and R404 to form a low pass filter which reduces the effects of transient noise on the accuracy of measurement. Resistors R401 and R402 act as a voltage divider to reduce the 0–5 volt feedback signal available from the microcontroller 100 to 0–3 volts, the signal from microcontroller 100 being fed back as a feedback voltage signal. The output of amplifier 404 is fed into the microcontroller 100, so that the microcontroller 100 forms a part of the feedback loop around amplifier 404.

Capacitor C408 acts to integrate the pulses from the microcontroller 100 as the feedback signal. In normal operation, the microcontroller 100 periodically samples the output of amplifier 404. When the output of amplifier 404 is high, microcontroller 100 sets the feedback voltage line high, which starts charging capacitor C408 towards 3 volts. This process repeats for each sampling interval until the voltage on capacitor C408 exceeds the input voltage on the non-inverting input (+) of amplifier 404, at which point the output of amplifier 404 goes low. Once the microcontroller 100 senses this output line of amplifier 404 going low, the feedback voltage is set low, which causes capacitor C408 to discharge towards 0 volts. This operation is repeated at each sampling interval until the output of amplifier 404 goes back high.

In this way, the microcontroller 100 is constantly trying to drive the inverting input (−) of amplifier 404 in a direction which will make it equal the voltage on its non-inverting input (+). An analog to digital conversion is thereby accomplished by counting the number of sampling intervals in which the feedback voltage is high for a fixed total number of sampling intervals. For convenience, if a fixed number of sampling intervals is set at 256, then counting the number of intervals in which the feedback voltage output is high will yield an 8-bit result in the range of 0–255 indicating the voltage on the battery. As discussed above with respect to FIG. 3, this sensed voltage is then used to control the start up of the vehicle and to determine if the start up is successful or whether the vehicle has stalled.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of The United States is:

1. A method for starting a vehicle, comprising the steps of:

generating a signal to a vehicle starter to crank a starter motor of the vehicle;

determining an approximate temperature of an engine of the vehicle;

measuring a first battery voltage;

turning on power to an ignition and accessories in the vehicle so that all turned on accessories have power supplied thereto;

measuring a second battery voltage which represents the battery voltage with a load applied thereto from the turned on accessories having power supplied thereto;

starting the vehicle by cranking a starter motor in the vehicle, wherein a duration of time that the vehicle starter motor is cranked is based on the determined temperature;

measuring the battery voltage continuously; and determining if the battery voltage falls below a predetermined battery voltage value indicating a stall condition.

2. The method for starting a vehicle according to claim 1, wherein the signal to the vehicle starter to crank the starter motor of the vehicle is generated by a remote transmitter.

3. The method for starting a vehicle according to claim 1, further comprising the step of automatically restarting the vehicle if it is determined that the battery voltage falls below the predetermined battery voltage value indicating a stall condition.

4. The method for starting a vehicle according to claim 1, further comprising the step of turning off power to the ignition and accessories of the vehicle if it is determined that the battery voltage falls below the predetermined battery voltage value indicating a stall condition.

5. The method for starting a vehicle according to claim 1, wherein the predetermined battery voltage value is equal to the measured second battery voltage plus an incremental voltage of 0.3 volts.

6. The method for starting a vehicle according to claim 1, wherein a look-up table storing cranking times for various temperatures is accessed to determine the duration of time that the vehicle starter motor is cranked.

7. The method for starting a vehicle according to claim 6, wherein the stored cranking times for various temperatures in the look-up table is adjusted based on an actual detected manual cranking time.

8. The method for remotely starting a vehicle according to claim 1, wherein the duration of time that the vehicle starter motor is cranked is further based on an elapse of time since the vehicle was last run.

9. A method for starting a vehicle, comprising the steps of:

generating a signal to a vehicle starter to crank a starter motor of the vehicle;

measuring a first battery voltage;

turning on power to an ignition and accessories in the vehicle, so that all turned on accessories have power supplied thereto;

measuring a second battery voltage which will represent the battery voltage with a load applied thereto from the turned on accessories having power supplied thereto;

starting the vehicle;

measuring the battery voltage continuously; and determining if the battery voltage falls below a predetermined battery voltage value.

10. The method for starting a vehicle according to claim 9, wherein the signal to the vehicle starter to crank the starter motor of the vehicle is generated by a remote transmitter.

11. The method for starting a vehicle according to claim 10, further comprising the step of automatically restarting the vehicle if it is determined that the battery voltage falls below the predetermined battery voltage value indicating a stall condition.

12. The method for starting a vehicle according to claim 9, further comprising the step of turning off power to the ignition of the vehicle if it is determined that the battery voltage falls below the predetermined battery voltage value indicating a stall condition.

13. The method for remotely starting a vehicle according to claim 9, wherein the predetermined battery voltage value is equal to the measured second battery voltage plus 0.3 volts.

14. A vehicle starter, comprising:

a temperature sensor for sensing an approximate temperature of an engine of the vehicle;

means for cranking a starter motor of the vehicle; and control means for determining a duration of time that the starter motor is cranked, based on the sensed temperature.

15. The vehicle starter according to claim 14, wherein the control means determines the duration of time that the starter motor is cranked by accessing a look-up table storing cranking times for various temperatures.

16. The vehicle starter according to claim 15, wherein the stored cranking times for various temperatures in the look-up table is adjusted based on an actual detected manual cranking time.

17. The remote vehicle starter according to claim 14, wherein the control means determines the duration of time that the starter motor is cranked further based on an elapse of time since the vehicle was last run.

18. The remote vehicle starter according to claim 15, wherein the control means determines the duration of time that the starter motor is cranked further based on an elapse of time since the vehicle was last run.

19. The remote vehicle starter according to claim 16, wherein the control means determines the duration of time that the starter motor is cranked further based on an elapse of time since the vehicle was last run.

* * * * *